United States Patent [19]

Anderson

[11] Patent Number: 4,615,577

[45] Date of Patent: Oct. 7, 1986

[54] ELECTRICAL CONNECTOR

[75] Inventor: Mark M. Anderson, Palos Verdes Peninsula, Calif.

[73] Assignee: Northrop Corporation, Hawthorne, Calif.

[21] Appl. No.: 750,981

[22] Filed: Jul. 2, 1985

Related U.S. Application Data

[63] Continuation of Ser. No. 599,873, Apr. 13, 1984, abandoned.

[51] Int. Cl.[4] ..... H01R 13/58

[52] U.S. Cl. ..... 339/103 M; 339/210 M

[58] Field of Search ..... 339/92 R, 92 M, 94 R, 339/94 A, 94 M, 101, 103 M, 206 R, 206 P, 207 R, 207 S, 208, 209, 210 R, 210 M

[56] References Cited

U.S. PATENT DOCUMENTS

| | | | |
|---|---|---|---|
| 3,904,265 | 9/1975 | Hollyday et al. | 339/208 |
| 4,125,312 | 11/1978 | Aimar | 339/208 |
| 4,220,385 | 9/1980 | Luca, Jr. et al. | 339/103 M |
| 4,436,361 | 3/1984 | McCleerey | 339/206 R |
| 4,484,792 | 11/1984 | Tengler et al. | 339/206 R |
| 4,493,521 | 1/1985 | Simon | 339/210 M |

FOREIGN PATENT DOCUMENTS

| | | | |
|---|---|---|---|
| 1048062 | 11/1966 | United Kingdom | 339/176 MP |

*Primary Examiner*—John McQuade
*Attorney, Agent, or Firm*—Terry J. Anderson

[57] ABSTRACT

Disclosed is an improved backshell for an electrical connector assembly, which accepts a plurality of conductor leads, the connector assembly including a receptacle for receiving the leads, and for attachment to a complementary connector by removable attaching means, and the backshell having interlocking portions for substantially enclosing a lead separator having holes for guiding individual leads into the receptacle whereby the connector assembly with the backshell can be readily assembled and disassembled, and can be installed on and removed from the complementary connector with minimum stress applied on the leads during installation, use and/or removal.

5 Claims, 3 Drawing Figures

ELECTRICAL CONNECTOR

This application is a continuation of application Ser. No. 599,873 filed Apr. 13, 1984, now abandoned.

FIELD OF THE INVENTION

The present invention relates to an improvement in a multiple lead electrical connector assembly for reducing stress on the leads during installation, use and removal of the connector assembly from a mating connector.

BACKGROUND TO THE INVENTION

Connectors for coupling electrical or signal conductor leads to mating connectors are well known. Electrical connectors are provided for connecting removably a plurality of conductor leads for input or output of information to and/or from an information or power source (instrument) to a receiver-user (instrument), through a mating or complementary connector. Often, vibration and other environmental factors cause failures as conductor leads become separated from their respective receptacles in the connector assembly. To reduce the occurrence of such failures, lead protection has been provided by encapsulating the conductors in the connector assembly with a plastic compound, referred to as a potting material. The objection to this procedure for permanently protecting the lead connections is that changing of conductor lead assignments, repairing leads, or replacing leads requires removing the potting material, and usually requires destruction and complete replacement of the connector assembly. Due to the significant steps involved in making such changes of leads, the connected instrument must be withdrawn from its intended task for the extended period necessary for repair either in a service facility or by a skilled technician.

BRIEF SUMMARY OF THE INVENTION

The present invention provides an improvement in an electrical connector assembly for coupling a plurality of conductor leads to a mating connector. Connectors protect conductor leads assigned to pin receivers of connectors, usually by permanent installation. Hence, the leads are not readily removable. In this improved connector assembly, the conductor leads are fixedly retained, yet readily removable for reconfiguration of the leads to a particular pin number, or for replacement if the lead should be damaged, or for replacement if a different connector receptacle is desired.

The improvements of the present invention enable field change or repair of the connector rather than requiring the time consuming return of the instrument to the repair facility. That is, when the connector is used on an instrument, such as test equipment, at a scene or in a laboratory but away from the usual repair facilities, the user may make repairs, or lead re-assignments, or receptable replacements with minimum time loss. The connector assembly includes a backshell of interlocking end and side pieces which may be disassembled upon removal of two attaching members by which the backshell couples the assembly to a complementary connector. After removing the attaching members, the end pieces of the backshell are displaced to release the side pieces. The backshell is then disassembled so that the conductor leads may be removed readily from the receptacle of the connector assembly. After the replacement of the leads, the disassembly steps are reversed to reassemble the connector for further use. Due to the short turn around time, the user can change lead assignments and make repairs or replacements to the conductor leads in the field.

A separator, enclosed within the backshell of the connector assembly, controls the area of conductor lead bending, placing that area outward of the location at which a lead may have been weakened when insulation was removed therefrom, or where the contact is crimped thereto. Further, the separator displaces this flexing area outward of the connector assembly backshell, whereby strain points, possibly affecting the leads and causing damage due to handling or environmental vibration, are displaced from immediately adjacent the connector assembly. By increasing the area over which strain, resulting from flexing and/or bending of conductor leads may occur, the likelihood of breakage of leads is reduced. Also, the separator, by receiving the contacts and leads in holes formed therein, prevents any strands of the leads or wires if broken, possibly due to faulty wire stripping or vibration, from contacting adjacent wire conductors, and causing circuit failure.

In practice, the backshell of the present invention is of a low profile construction permitting the connector assembly to be used in "tight" locations. This low profile overcomes the space limitations created by known backshells used in connector assemblies.

An object of the invention is to provide an improved connector assembly having a backshell capable of assembly and disassembly permitting in the field repair of the connector assembly.

Another object is to provide for the multi-lead connector assembly a lead separator to maintain separation of the leads.

Another improvement of the invention is the provision of a lead separator within a backshell of a connector assembly to displace the flex points of insulator conductor leads beyond the length from which insulation has been removed.

BRIEF DESCRIPTION OF THE DRAWINGS

Further and other objects of the present invention will become more apparent from the description of the accompanying drawings in which like numerals refer to like parts.

In the drawings.

DETAILED DESCRIPTION OF THE INVENTION

Figure 1:
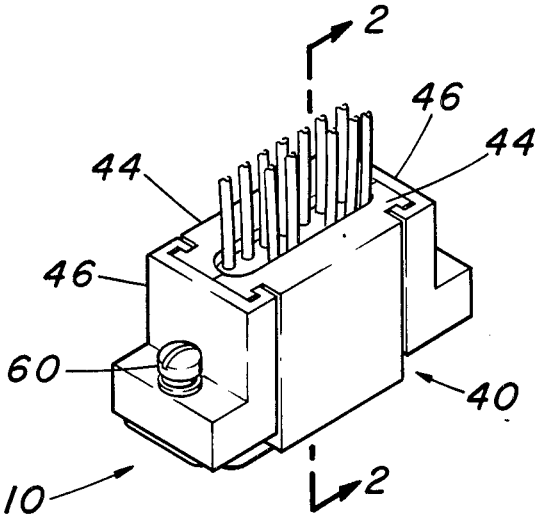
FIG. 1 is a perspective view of a connector assembly of the present invention with the backshell assembled.
Figure 2:
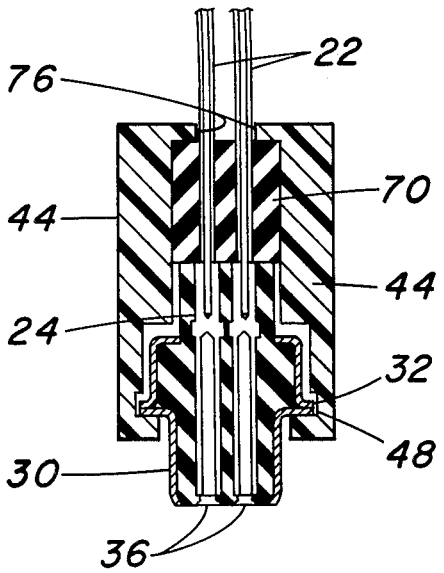
FIG. 2 is a cross sectional view of the connector assembly of the invention taken along section line 2—2 of FIG. 1.
Figure 3:
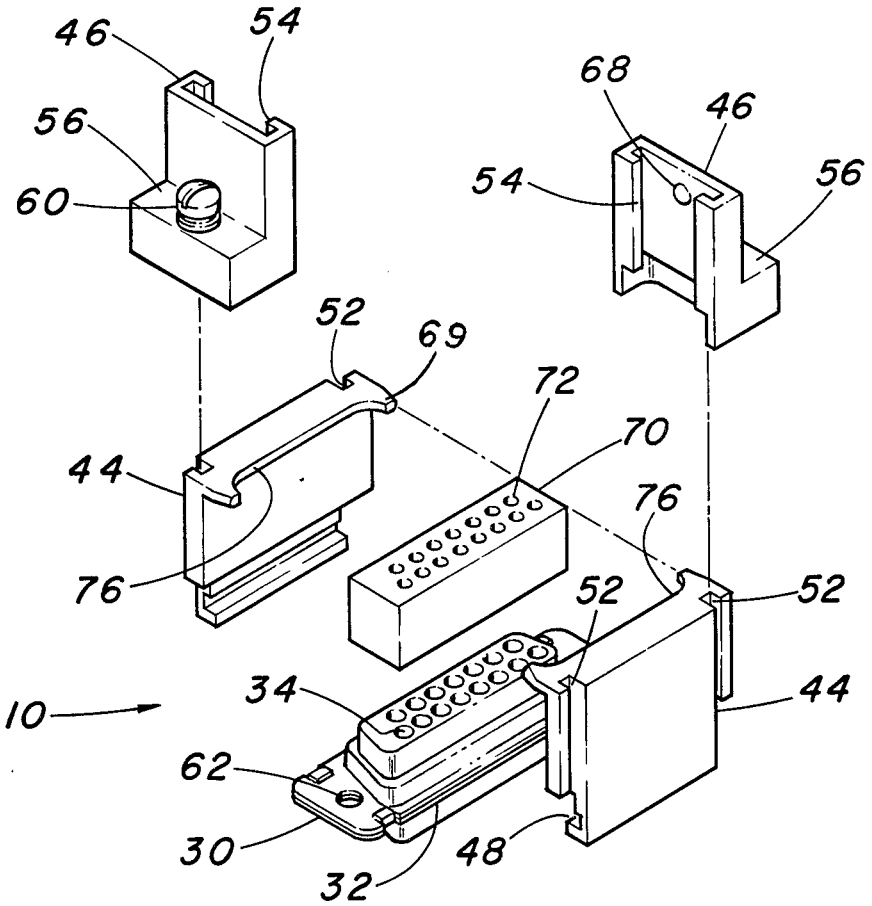
FIG. 3 is an exploded view of the connector assembly and backshell.

As shown in the drawings, an improved multiple lead electrical connector assembly 10 is dimensioned for coupling with a complementary connector (not shown). The complementary connector may either be fixed to a base or be arranged on the ends of other wire lead conductors. The dimensions of the connector assembly 10 are determined by the number of insulated wire lead conductors 22. Typical of known connectors of the class shown are Type D connectors, having as few as 9 or as many as 50 pins (plug type or pin receivers (receptacle type) arranged in two or three rows, usually with the pins in one row offset from the pins in another row.

The insulated conductor leads or wires 22 are prepared for insertion into the connector assembly 10 by stripping of some of the insulation from a short length of the insertion end thereof, typically about 3/16th of an inch or 5 millimeters. A contact 24 is attached to the bared wire end, using a tool that crimps the contact tightly onto the conductor. The contacts 24 with the wire 22 attached are thereafter inserted into the connector assembly 10. Too often, stripping of the insulation causes weakening of the wire lead due to partial or complete cutting of one or more strands of the wire. Flexing or bending of the wires at this point are primary causes for wire breakage or other failure in the harsh environment of use of the connector assembly.

A preferred embodiment of the connector assembly 10 includes a conductor lead receiving receptacle 30 of known construction. Such a receptacle has a ledge or rim 32 formed around the perimeter thereof, proximately along the mid-line of the thickness/depth dimension thereof. A plurality of conductor lead receivers 34 are exposed to one side of the receptacle to receive the contacts 24. On the opposite side of the receptacle are a plurality of pin receivers or pins 36 for mating with pins or pin receivers of complementary connectors (not shown) to complete circuits when the connectors are assembled together.

A multi-part backshell 40, configured of interlocking side pieces 44 and end caps 46, forms a housing partially enclosing the receptacle 30. For a given connector size, the side pieces and end pieces may be identical. Portions of the interior of both side pieces 44 are provided with receptacle retainers, such as ledges or the recesses 48, as shown. The retainers are arranged for mating with sections of the rim 32 of the receptacle 30. On the ends of the side pieces 44 are grooves 52, extending the height of these side pieces. Runners 54 of the end cap portions 46 engage in the grooves 52 to clamp the side pieces 44 together to retain the receptacle 30 therebetween.

To enable attaching connector assembly 10 to a mating connector, a lip 56 is formed as a part of each end cap 46. The lip is provided with a hole (not shown) through which can pass an attaching member 60, shown as a screw. The attaching member 60 is designed to pass through a coresponding hole 62 in the rim 32 of the receptacle 30, and into a complementary hole in the mating connector to cause retention together of the coupled connectors. The backshell 40 requires no other fasteners to complete assembly or to retain the integrity of the assembled backshell as a unitary structure. However, a detent 68 is provided on the interior surface of the end cap portions 46 to engage tang-like spacers 69 of the backshell portions 44 to retain the backshell together until assembly with the fasteners.

Internally of the backshell 40, when assembled, a lead separator 70 is positioned, substantially enclosed by backshell portions 44, 46, and the receptacle 30. The separator, formed of yieldable, electrical insulating material, such as silicone rubber, is shown as a block of material. The width of the block is slightly greater than the predetermined spacing between the backshell portions 44, and slightly greater than the width of the receptacle 30, but effectively displaces the point at which conductor leads may flex beyond the area from which insulation has been removed and beyond the backshell. A plurality of holes 72 in the lead separator block are in a pattern to match the pattern of the receivers 34 of the receptacle. To retain the lead separator in the backshell, the side pieces of the backshell are configured at the lead out edge with inwardly extending flanges 76, which terminate with the tang-like spacers 69 to hold apart the inner flange edges. The conductor leads 22 pass into and out of the connector assembly through this space in the backshell.

The assembly procedure for the connector assembly 10 is simply to align and press the side pieces 44 of the backshell 40 firmly against the sides of the lead separator 70 and of the receptacle 30, and to guide the runners 54 of the end cap pieces 46 into the retaining grooves 52 along the ends of the side pieces until the end pieces snap into place as the runners seat in the grooves of the side pieces. Part of the snap action is caused by the detent 68 passing over the outer edges of the inwardly extending tang-like spacer ends 69 of side backshell portions 44. The contacts may be affixed to the conductors before or after the conductors are passed through the separator. However, the contacts are seated in the receptacle prior to assembly of the connector assembly. Thus, the backshell retains the lead separator in position relative to the receptacle with minimum stress being applied on the conductor leads 22 or contacts 24 thereon.

Following assembly of the connector assembly 10, the backshell 40 and receptacle 30 are held together. Thereafter, the fastener members 60 are threaded through the receptacle and into the mating connector to secure the backshell 40 and the receptacle 30 of the connector assembly to the mating connector.

By the construction as shown in this preferred embodiment, the conductor leads can be removed, reassigned and/or repaired in the field with minimum effort and time loss. Further, the connector assembly with the backshell reduces the likelihood of damage to the conductors, upon attachment to, use, and removal from complementary connectors.

The embodiment shown is illustrative of the invention in which modifications and substitutions can be made without departing from the spirit and scope thereof.

I claim:

1. A multiple lead, electrical connector assembly comprising a connector of the plug or receptacle type adapted for coupling the same to contacts of a complementary connector to which the connector assembly may be attached, said connector including a shell having a laterally extending rim, an insulator block captured by said shell, said insulator block having passages for accepting a plurality of conductor leads having a plurality of contacts affixed to their respective ends, said insulator block serving to capture said contacts and support the same in a predetermined spatial arrangement, a lead separator block made of flexible insulating material having a plurality of individual lead passageways formed therethrough and arranged in the same spatial relation as the contact arrangement of the insulator block for yieldably supporting each conductor lead from the electrical contact through said separator block to a remote face thereof, said plurality of leads extending from said connector to the remote face in substantially the same spatial arrangement as the contacts to which they are attached, backshell means for gripping said connector and for capturing said separator block around said leads and forming a unitary structure thereof, said backshell means having a lead opening at said remote face of said separator block large enough to allow free passage of all the leads from the remote face of the separator block, said leads being yieldably supported solely by the separator block against externally imposed stresses, said backshell means including a pair of side pieces, each of said side pieces having an interior wall extending above and below the rim and a recess for accepting the rim, a pair of end caps, means on said end caps and said side pieces for interconnecting the caps and pieces together securely and slightly compress the separator block whereby the shell, end caps, side pieces, and separator block form said unitary structure.

2. The assembly as in claim 1 in which said separator block is made of yieldable rubber having a width slightly greater than the spacing of the backshell portions, and said side pieces further include walls extending away from the receptacle on the side adjacent to said separator block and terminating in a pair of projections facing towards like projections on the other side piece to define said opening and to space said side pieces apart a predetermined distance slightly less than the width of the separator block, whereby, in assembly, the side pieces can be yieldably pushed toward each other and to slightly compress the separator block until the projections meet and the end pieces thereafter installed to obtain a tight fit established by the resistance of the separator block.

3. The assembly as in claim 1 in which said means for interconnecting the caps and side pieces includes means forming outwardly facing U-shaped channels extending exteriorly along each end of the side pieces from the top thereof down to the recess, said end caps being L-shaped and including a bottom wall and an upstanding wall extending from the rim of the shell to the top of the side pieces, and means forming inwardly facing channels along each side of the upstanding wall of the end cap so that the end caps can be slid down in contact with the side piece channels until the bottom wall of each end cap is proximate the shell rim.

4. The assembly as in claim 1 wherein each of said end caps is L-shaped to form a bottom wall proximate the rim of the shell, when assembled, said bottom wall having a hole therein and said rim having a hole for a fastening means to pass, said hole in said rim being aligned with the hole of said bottom wall.

5. The connector assembly as in claim 2 further including detent means provided on said end caps for snapping past said projections when the end caps and side pieces are assembled.

* * * * *